US005628663A

United States Patent [19]

Potter

[11] Patent Number: 5,628,663

[45] Date of Patent: May 13, 1997

[54] FABRICATION PROCESS FOR HIGH-FREQUENCY FIELD-EMISSION DEVICE

[75] Inventor: Michael D. Potter, Grand Isle, Vt.

[73] Assignee: Advanced Vision Technologies, Inc., Rochester, N.Y.

[21] Appl. No.: 524,171

[22] Filed: Sep. 6, 1995

[51] Int. Cl.[6] ..... H01J 9/02

[52] U.S. Cl. ..... 445/49; 445/50

[58] Field of Search ..... 445/24, 50, 49; 313/309, 336

[56] References Cited

U.S. PATENT DOCUMENTS

| | | | |
|---|---|---|---|
| 4,578,614 | 3/1986 | Gray et al. | 313/309 |
| 4,721,885 | 1/1988 | Brodie | 313/576 |
| 4,728,851 | 3/1988 | Lambe | 313/309 |
| 4,827,177 | 5/1989 | Lee et al. | 313/306 |
| 4,901,028 | 2/1990 | Gray et al. | 330/54 |
| 4,987,377 | 1/1991 | Gray et al. | 330/54 |
| 4,990,766 | 2/1991 | Simms et al. | 250/213 VT |

(List continued on next page.)

OTHER PUBLICATIONS

C. A. Spindt "A Thin-Film Field-Emission Cathode" J. Applied Physics vol. 39, No. 7 (1968) pp. 3504–3505.

R. F. Greene et al. "Vacuum Microelectronics" Proc. IEDM 1989, (1.3.1–1.3.5), pp. 15–19.

H. H. Busta et al. "Lateral Miniaturized Vacuum Devices" Proc. IEDM 1989, (20.4.1–20.4.4), pp. 533–536.

J. E. Cronin et al. "Field Emission Triode Integrated-Circuit Construction Method" IBM Technical Disclosure Bulletin, vol. 32, No. 5B (Oct. 1989) pp. 242–243.

(List continued on next page.)

*Primary Examiner*—Kenneth J. Ramsey
*Attorney, Agent, or Firm*—Theodore R. Touw

[57] ABSTRACT

An improved high-frequency field-emission microelectronic device (10) has a substrate (20) and an ultra-thin emitter electrode (30) extending parallel to the substrate and having an electron-emitting lateral edge (110) facing an anode (40) across an emitter-to-anode gap (120). A control electrode (70), having a lateral dimension only a minor fraction of the emitter-to-anode gap width, is disposed parallel to the emitter and spaced apart from the emitter by an insulator (60) of predetermined thickness. A vertical dimension of the control electrode is only a minor fraction of the height of the anode. The control electrode may substantially surround a portion of the anode, spaced from the anode in concentric relationship. Inter-electrode capacitance between the emitter and the control electrode has only an extremely small value, consisting of only a very small area term and a very small fringing-field term, thus allowing operation of the microelectronic device at higher frequencies or switching speeds than heretofore. Inter-electrode capacitance between the control electrode and the anode also has only an extremely small value, thus improving higher frequency performance further. Devices having a plurality of control electrodes may also be made with improved inter-electrode capacitance. In order to consistently realize improved performance, a fabrication process (S1–S18) is specially adapted for manufacturing the device with small and precise dimensions and suitably precise alignment. The specially adapted process uses two sacrificial materials (150 and 160), one of which forms a temporary mandrel, and uses a conformal conductive layer to form each control electrode while automatically achieving the required alignment precision.

19 Claims, 6 Drawing Sheets

U.S. PATENT DOCUMENTS

| | | | |
|---|---|---|---|
| 5,030,895 | 7/1991 | Gray | 315/350 |
| 5,057,047 | 10/1991 | Greene et al. | 445/24 |
| 5,144,191 | 9/1992 | Jones et al. | 313/308 |
| 5,214,347 | 5/1993 | Gray | 313/355 |
| 5,233,263 | 8/1993 | Cronin et al. | 313/309 |
| 5,266,155 | 11/1993 | Gray | 156/651 |
| 5,281,890 | 1/1994 | Kane | 313/309 |
| 5,308,439 | 5/1994 | Cronin et al. | 156/656 |
| 5,313,140 | 5/1994 | Smith et al. | 315/169.1 |
| 5,320,570 | 6/1994 | Kane | 445/24 |
| 5,382,185 | 1/1995 | Gray et al. | 445/49 |

OTHER PUBLICATIONS

Brodie, "Physics1 Considerations in Vacuum Microelectronics Devices", IEEE Transactions on electron devices, vol. 36, No. 11 (Nov. 1989) pp. 2641–2644.

W. J. Orvis et al., "Modeling and Fabricating Micro–Cavity Integrated Vacuum Tubes," IEEE Transactions on Electron Devices, vol. 36, No. 11 (Nov. 1989) pp. 2651–2657.

W. N. Carr et al. "Vacuum Microtriode Characteristics" J. Vac. Sci. Technol. vol. A8, No. 4 (Jul./Aug. 1990), pp. 3581–3585.

S. Kanemaru et al. "Fabrication and Characterization of Lateral Field–Emitter Triodes" IEEE Transactions on electron Devices, vol. 38, No. 10 (Oct. 1991) pp. 2334–2336.

A. Kaneko et al. "Wedge–Shaped Field Emitter Arrays for Flat Display" IEEE Transactions on Electron Devices, vol. 38, No. 10 (Oct. 1991) pp. 2395–2397.

R. A. Lee et al., "Semiconductor Fabrication Technology Applied to Micrometer Valves" IEEE Transactions on Electron Devices, vol. 36, No. 11 (Nov. 1989) pp. 2703–2708.

Anonymous "Ionizable Gas Device Compatible with Integrated Circuit Device Size and Processing" reproduced from Research Disclosure No. 305 (Sep. 1989).

K. Derbyshire "Beyond AMLCDs: Field emission displays?" Solid State Technology, vol. 37, No. 11 (Nov. 1994) pp. 55–65.

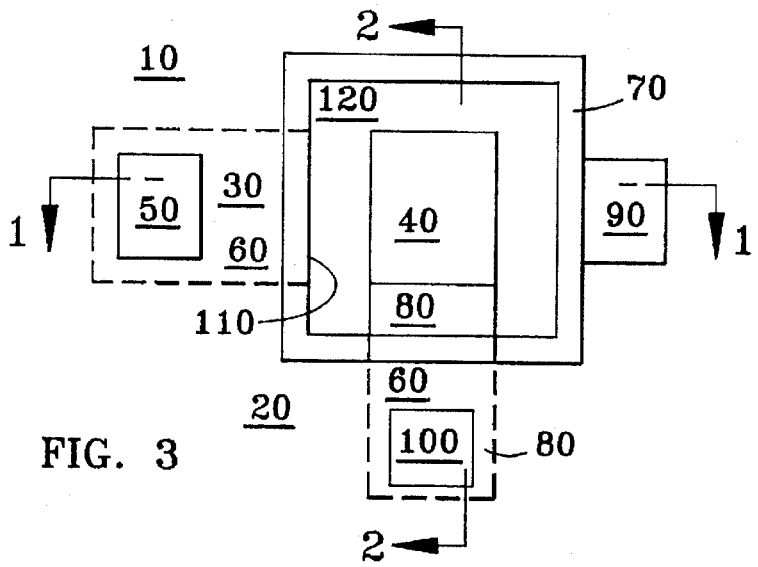
FIG. 3
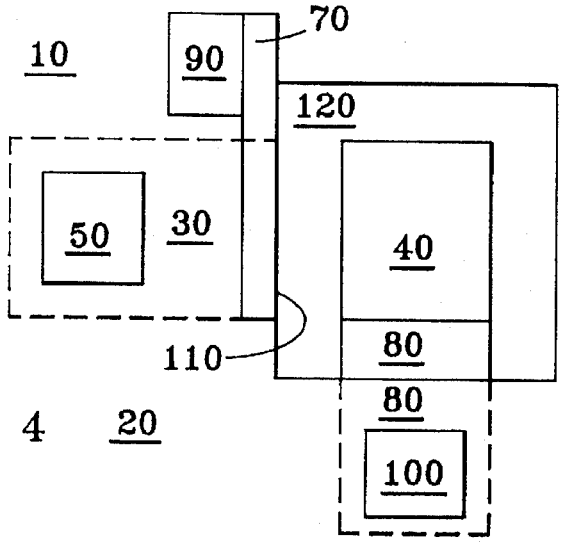
FIG. 4 20
FIG. 5
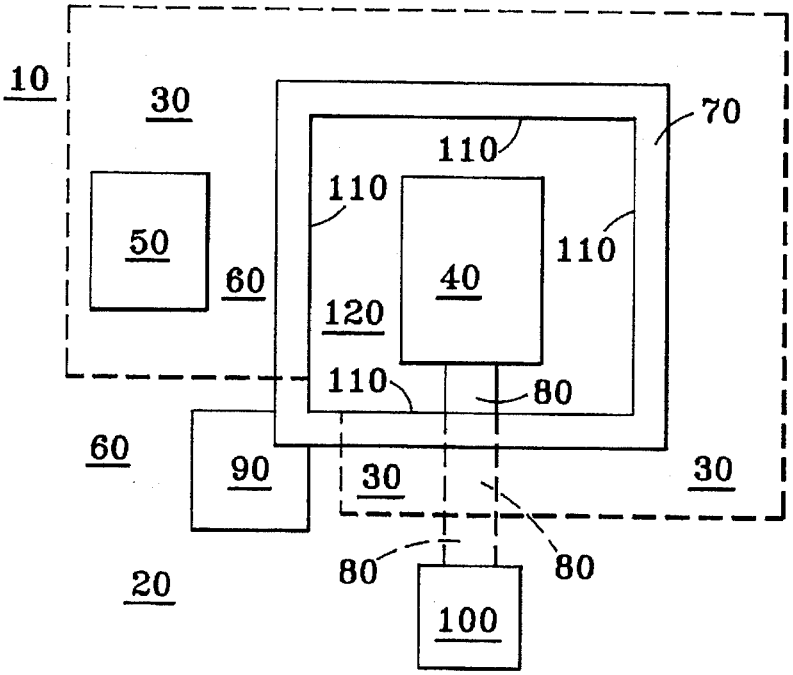

| |
|---|
| FIG. 6a |
| FIG. 6b |

FABRICATION PROCESS FOR HIGH-FREQUENCY FIELD-EMISSION DEVICE

This application is related to co-pending application Ser. No. 08/524,225 by Michael D. Potter titled "High-Frequency Field-Emission Device," filed in the United States Patent and Trademark Office on Sep. 6, 1995.

FIELD OF THE INVENTION

This invention relates generally to microelectronic devices and more particularly to high frequency microelectronic devices of the type using a cold-cathode field-emission electron source.

BACKGROUND OF THE INVENTION

Microelectronic devices using a cold-cathode field-emission electron source are useful in many applications previously employing vacuum tubes or semiconductor devices, especially microelectronic semiconductor devices. Field-emission microelectronic devices are especially useful in applications that require high frequency operation or fast switching speeds and have further advantages of small size, low power consumption, reduced complexity, and low manufacturing cost. The many diverse uses for high-frequency field-emission microelectronic devices include high-speed computer logic and memory circuits, and may also include high-speed flat panel displays for displaying images and for displaying character or graphic information. New applications of terahertz frequency signal generators and amplifiers, which can use high-frequency field-emission microelectronic devices, are being vigorously developed.

A review article on the general subject of vacuum microelectronics was published in 1992: Heinz H. Busta, "Vacuum Microelectronics—1992," Journal of Micromechanics and *Microengineering*, vol. 2, no. 2 (June 1992), pp. 43–74. An article by Katherine Derbyshire, "Beyond AMLCDs: Field Emission Displays?" Solid State Technology, vol. 37, no. 11 (Nov. 1994), pp. 55–65, summarized fabrication methods and principles of operation of some of the competing designs for field-emission devices and discussed some applications. The theory of cold field emission of electrons is discussed in many textbooks and monographs, including the monograph by Robert Gomer, Field Emission and Field Ionization (Cambridge, Mass., Harvard University Press, 1961), chapter 1, pp. 1–31, and the monograph by R. O. Jenkins and W. G. Trodden, Electron and Ion Emission From Solids (New York, N.Y., Dover Publications, Inc., 1965), chapter 4, pp. 35–43.

NOTATIONS AND NOMENCLATURE

The terms emitter and cathode are used interchangeably throughout this specification to mean a field-emission cathode. The term "lateral emitter" refers to an emitter extending substantially parallel to a device's substrate. The term "lateral dimension" refers to a dimension measured along an axis substantially parallel to the device's substrate. The term "vertical dimension" refers to a dimension measured along an axis substantially perpendicular to a device's substrate. The term "control electrode" is used herein to denote an electrode that is analogous in function to the control grid in a vacuum-tube triode, i.e. in controlling current flowing in the device. Such electrodes have also been called "gates" in the field-emission device related art literature. As is known in the art, such a control electrode, suitably biased, may be used as an extraction electrode by affecting the electric field at a field-emitter's emitting tip or edge.

DESCRIPTION OF THE RELATED ART

K. R. Shoulders, in the chapter "Microelectronics Using Electron-Beam-Activated Machining Techniques" of F. L. Alt (Ed.) Advances in Computers (New York, Academic Press, 1961) vol. 2, pp. 135–197, proposed developing a number of vacuum microelectronic devices ("tunnel effect devices" ) using field emission of electrons into a vacuum, to be fabricated using electron-beam activated micromachining processes. The author estimated (pages 154 and 163) that it might be possible to reduce the impedance of a vacuum tunnel tetrode device (FIG. 1 of the reference, at page 160) to 100,000 ohms and its inter-electrode capacitance to approximately 10–16 farads, yielding a time constant of about $10^{-11}$ second.

C. A. Spindt, in "A Thin-Film Field-Emission Cathode," J. Applied Physics vol. 39, no. 7 (1968), pp. 3504–3505, disclosed a thin-film field-emission cathode with an array of open micron-size cavities, each cavity containing a single molybdenum field-emitting cone. R. F. Greene et al., in "Vacuum Microelectronics," Proceedings IEDM 1989, (1.3.1–1.3.5), pp. 15–19, disclosed a three terminal micron scale vacuum FET (FIG. 2 of the reference and reference 3) identified with a device of H. F. Gray et al. (1986) at the Naval Research Laboratory. H. H. Busta et al. in "Lateral Miniaturized Vacuum Devices," Proceedings IEDM 1989, (20.4.1–20.4.4), pp. 533–536, disclosed two types of lateral cold emitter triodes. One type consisted of triangular shaped metallic emitters separated several microns from a collector electrode. The second type consisted of a tungsten filament emitter that is anchored to the sidewall of a polycrystalline silicon layer. Both types had an extraction electrode and a collector.

J. E. Cronin et al. (including the present inventor), in "Field Emission Triode Integrated-Circuit Construction Method," IBM Technical Disclosure Bulletin, vol. 32, no. 5B (Oct. 1989), pp. 242–243, disclosed a process using microelectronic device-processing steps to make integrated circuits comprised of field-emission triodes for the active devices instead of semiconductor devices. I. Brodie, in "Physical Considerations in Vacuum Microelectronics Devices," IEEE Transactions on Electron Devices, vol. 36, no. 11 (Nov. 1989), pp. 2641–2644, described physical considerations that must be taken into account when the dimensions of a triode vacuum tube are reduced to micrometer and submicrometer levels. This article showed a graph (FIG. 4 of the reference) of electron transit time in vacuum vs. various semiconductor materials, calculated for a uniform electric field across a channel 0.5 micrometer wide. The calculated result of $3.8\times10^{-13}$ second for the vacuum case was conservative (i.e. somewhat greater) compared with transit time in a real field-emission microelectronic device, since much of the electrical field in the latter is concentrated close to the emitter tip.

W. J. Orvis et al., in "Modeling and Fabricating Micro-Cavity Integrated Vacuum Tubes," IEEE Transactions on Electron Devices, vol. 36, no. 11 (Nov. 1989), pp. 2651–2657, published results of modeling miniature, vacuum, field-emission diodes and triodes. This article pointed out among other results that the maximum speed of electrons in such devices is at least two orders of magnitude higher than the speed in silicon (p. 2652) and that such triode devices may be operated with a control-grid bias that is more positive than that of the cathode (p. 2656). W. N. Cart et al., in "Vacuum Microtriode Characteristics," Journal of Vacuum Science & Technology, vol. A8, no. 4 (July/Aug. 1990), pp. 3581–3585, published results of simulation modeling of some lateral vacuum microelectronic devices with wedge-shaped field-emission cathodes.

Gray et al. (U.S. Pat. No. 4,578,614) disclosed an ultra-fast field-emitter switching device wherein a positive pulse is applied to a gate, and a collector is held at a potential higher than the gate. Because of the field emitter geometry, the electron transport is extremely fast. The ultra-fast switching speed is attained because the electrons reach near-maximum velocity within a few field tip diameters of the source.

Brodie (U.S. Pat. No. 4,721,885) disclosed diode and triode arrays of high speed integrated microelectronic tubes, including a plate-like substrate upon which an array of field-emitter cathodes is located and including an anode electrode spaced from each cathode. The tubes are operated at voltages such that the mean free path of electrons (traveling in a gas between the cathode and anode electrodes) is equal to or greater than the spacing between the tip of the cathode electrode and the associated anode electrode. Lambe (U.S. Pat. No. 4,728,851) disclosed a field emitter device utilizing a gate electrode adjacent to a carbon fiber electron emitter cathode for controlling the initial flow of electrons between the cathode and the collector element. Subsequent disconnect of the gate electrode from its power source does not affect the electron flow and thereby provides a bistable memory type device.

Lee et al. (U.S. Pat. No. 4,827,177) disclosed field emission vacuum devices in which first, second, and third electrode structures are formed on a silicon dioxide layer by depositing a metallic layer and etching away unwanted portions of the layer, the second electrode structure acting as a control electrode. Simms et al. (U.S. Pat. No. 4,990,766) disclosed a microscopic voltage controlled field emission electron amplifier device consisting of a dense array of field-emission cathodes with individual cathode impedances employed to modulate and control the field emission currents of the device. These impedances are selected to be sensitive to an external stimulus such as light, x-rays, infrared radiation or particle bombardment.

Gray et al. (U.S. Pat. Nos. 4,901,028 and 4,987,377) disclosed field-emitter array integrated distributed amplifiers in which dielectric material and electrically conductive material combine to form cathodes, grids, and anodes in a module forming one or more amplifier cells embedded in a matrix of reactive impedances that form companion stripline-like transmission lines. Gray (U.S. Pat. No. 5,030,895) disclosed a field-emitter array comparator in which voltage or current input signals supplied to at least two deflectors control the selective deflection of a beam of electrons to one collector of a collector array of at least two collectors. Greene et al. (U.S. Pat. No. 5,057,047) disclosed a low capacitance field-emitter array and fabricating method which uses a substrate as both an emitter tip mold and an insulating layer. Once the emitter is formed, the remaining fabrication steps are self-aligning. The field emitter array thus formed exhibits high input impedance at high frequency, making the field emitter array suitable for high frequency uses.

Jones et al. (U.S. Pat. No. 5,144,191) disclosed a microelectronic field emitter including a horizontal emitter electrode and a vertical extraction electrode on the horizontal face of a substrate. An end of the horizontal emitter electrode and the end of the vertical extraction electrode form an electron emission gap between them. The structure of Jones et al. tends to reduce emitter-to-extraction-electrode capacitance somewhat in comparison with earlier field emitter designs.

Gray (U.S. Pat. Nos. 5,214,347 and 5,266,155) disclosed a field-emitter array device which includes a substrate supporting thin-film layers of conductive material and intervening thin-film layers of insulative material. The lateral edges of the thin-film layers form a field emitter array including a field emitter edge electrode interposed between a pair of control electrodes. A process for making the emitter device includes forming a plurality of first and second layers of insulating material alternately disposed between first, second, and third layers of conductive material, forming a channel through the thickness of the layers and oriented perpendicular thereto, exposing the lateral edges of the layers of conductive and insulating materials adjacent to the channel to form a field emitter edge electrode interposed between a pair of control electrodes. Gray's process includes angled deposition of anode material, which unfortunately can require all devices on a given substrate to have the same orientation. Gray et al. (U.S. Pat. No. 5,382,185) disclose thin-film edge field-emitter devices in which all of the devices include a plurality of thin films deposited on the side wall of a non-flat substrate. The gated emitter devices include alternating conductive and electrically insulating layers, and upper parts of the latter are removed to expose the upper edges of the conductive layers, with a central one of these conductive layers comprising an emitter.

Kane (U.S. Pat. No. 5,281,890) disclosed a field emission device having an anode centrally disposed with respect to an annular edge emitter. Cronin et al. (including the present inventor) (U.S. Pat. Nos. 5,233,263 and 5,308,439) disclosed lateral cathode field-emission devices and methods of fabrication, producing cathode tips on the order of several hundred Angstroms as well as exact spacing of cathode to gate and cathode to anode. Smith et al (U.S. Pat. No. 5,313,140) disclosed a field emission device employing an integrally formed capacitance and a switch serially connected between a conductive element and a current source to provide substantially continuous emitted electron current during selected charging periods and non-charging periods. Kane (U.S. Pat. No. 5,320,570) disclosed a method for manufacturing high performance field emission devices in which the electron emitters are disposed on a plurality of projections (which may be on the order of 100 μm in extent), providing for significant reduction in inter-electrode capacitance.

S. Kanemaru et al., in "Fabrication and Characterization of Lateral Field-Emitter Triodes," IEEE Transactions on Electron Devices, vol. 38, no. 10 (Oct. 1991), pp. 2334–2336, disclosed a fabrication method and a field-emitter triode with tungsten electrodes arranged laterally on a quartz glass substrate, fabricated using photolithography and dry etching techniques. A. Kaneko et at., in "Wedge-Shaped Field Emitter Arrays for Flat Display," IEEE Transactions on Electron Devices, vol. 38, no. 10 (Oct. 1991), pp. 2395–2397, disclosed a fabrication process and a wedge-shaped field emitter array having an emitter formed by a 500 nm thick Mo film deposited on an Al stripe electrode layer, and having a gate electrode formed by a 200 nm thick Cr film on a $SiO_2$ layer with a thickness nearly the same as that of the Mo film. R. A. Lee et al., in "Semiconductor Fabrication Technology Applied to Micrometer Valves," IEEE Transactions on Electron Devices, vol. 36, no. 11 (Nov. 1989), pp. 2703–2708, disclosed process methods for fabrication of vacuum microelectronic devices, including methods for tip sharpening and dielectric planarization. An anonymous publication, "Ionizable Gas Device Compatible with Integrated Circuit Device Size and Processing," Research Disclosure No. 305 (Sept. 1989), disclosed a method using processing techniques developed for manufacture of integrated circuits to make an ionizable gas device.

While many of the microelectronic devices in the related art have had small enough dimensions and high enough electric fields such that electron transit time from emitter to anode or collector electrode is short, a more important and dominant factor limiting high operating frequencies has become the inter-electrode capacitances. Device structures having many alternating conductive and electrically insulating layers, while very useful, are unfortunately not especially suited for high frequency operation, due to inherently relatively high inter-electrode capacitance. This capacitance problem has been ameliorated somewhat by structures such as that by Jones et al. described above. In many device structures of the related art, the width of the cavity separating extraction electrode and collector electrode is determined by a trench etching process, which thus also determines the precision with which the extraction-to-collector-electrode capacitance can be controlled. Some device structures have had an extraction electrode covering all but a small emitter portion of a vertical sidewall and have had a collector electrode or anode covering a second vertical sidewall opposite the extraction electrode. In such devices, unfortunately, the extraction-electrode-to-collector-electrode capacitance is relatively high and furthermore tends to increase with reduced microelectronic device dimensions.

PROBLEMS SOLVED BY THE INVENTION

While it is recognized in the art that field-emission microelectronic devices have the potential to operate at very high frequencies or fast switching times, even faster than some semiconductor devices fabricated in gallium arsenide, that level of high-frequency performance has been difficult to achieve in practice. A particular problem has been that prior art devices have had inherently high inter-electrode capacitances between the emitter and/or the anode and a control electrode, extraction electrode, or gate. The high-frequency microelectronic device of this invention reduces both of those capacitances to an extremely small value and thus allows improved high-frequency operation. These capacitances, often depending on lithographic tolerances, have also been difficult to control precisely and reproducibly. A process specially adapted for fabricating the high-frequency device automatically provides sufficiently small, precise, and reproducible dimensions and sufficiently accurate relative alignment of the various electrodes so that improved high-frequency performance may be consistently realized.

OBJECTS AND ADVANTAGES OF THE INVENTION

An important object of the invention is a microelectronic device with improved high-frequency performance. More particularly, an object of the invention is a field-emission microelectronic device operable at higher frequencies than heretofore. An object related to logic devices is a microelectronic device capable of switching between on and off states in extremely short time intervals. Another particular object of the invention is a field-emission device that has reduced inter-electrode capacitances. A related object is a microelectronic device whose upper frequency limit is extended by virtue of having reduced inter-electrode capacitances. In further detail, an object of the invention is a field-emission microelectronic device whose inter-electrode capacitances between its control electrode and its emitter and anode are each reduced to an extremely small value. A related object of the invention is a field-emission microelectronic triode device whose control electrode has dimensions that are only a minor fractional part of the device's emitter-to-anode gap, or of the path length of an electron moving from an emitter to an anode. Similarly, another such object of the invention is a field-emission microelectronic triode device whose control electrode has dimensions that are only a minor fractional part of the anode's height. Yet another object of the invention is a control electrode of such small dimensions relative to the anode size and to the emitter-to-anode gap width, that high-frequency field-emission microelectronic devices may be made smaller than heretofore, without undue increase in inter-electrode capacitances.

Some overall objects of the invention include device structures and fabrication processes to provide extremely fine cathode edges or tips and precise control of the inter-element dimensions, alignments, inter-electrode capacitances, and required bias voltages. Another object of the invention is a high-frequency microelectronic device that may be integrated with other microelectronic devices, using interconnection wiring dimensions commonly used for VLSI devices. Other objects include improved high-frequency microelectronic devices having multiple control electrodes, such as tetrodes and pentodes which also benefit from reduced inter-electrode capacitance. Another object of the invention is a high-frequency microelectronic device that can be fabricated from substantially transparent materials. A related object is a high-frequency microelectronic device for use in displays that may be used in applications that require transparency, such as so-called "augmented reality" displays which may be used in a light-transmissive mode. Other objects of the invention include high-frequency microelectronic devices which can be fabricated to operate either in a vacuum or in a gas atmosphere in which the mean free path of electrons exceeds the spacing between their cathodes and their corresponding anodes.

Yet another object of the invention is a fabrication process specially adapted to fabricate an improved high-frequency microelectronic device economically and efficiently. A particular object in this regard is a fabrication process that can use methods and equipment commonly used for semiconductor manufacturing. An important object of the invention is a fabrication process specially adapted to automatically provide sufficiently precise and reproducible dimensions and relative alignment of the various electrodes of the high-frequency field-emission microelectronic device so that its improved high-frequency performance may be consistently realized.

SUMMARY OF THE INVENTION

An improved high-frequency field-emission microelectronic device has a substrate and an ultra-thin emitter electrode extending parallel to the substrate and having an electron-emitting lateral edge facing an anode across an emitter-to-anode gap. A control electrode, having a lateral dimension only a minor fraction of the emitter-to-anode gap width, is disposed parallel to the emitter and spaced apart from the emitter by an insulator of predetermined thickness. A vertical dimension of the control electrode is only a minor fraction of the height of the anode. The control electrode may substantially surround a portion of the anode, spaced from the anode in concentric relationship. The interelectrode capacitance between the emitter and the control electrode has only an extremely small value, consisting substantially of only a very small area term and a very small fringing-field term, thus allowing operation of the microelectronic device at higher frequencies or switching speeds than heretofore. The inter-electrode capacitance between the control electrode and the anode also has only an extremely small value, thus improving higher frequency performance further. Similarly, devices having a plurality of control electrodes, such as tetrodes and pentodes, may also be made with improved interelectrode capacitance. Because of the microelectronic device's small size and high electric field when operating, electron transit times are very short, and inter-electrode capacitances dominate the upper limits of operating frequency. In order to consistently realize the improved high-frequency performance of the field-emission microelectronic device, a fabrication process is specially adapted for manufacturing the device with suitably small and precise dimensions and suitably precise inter-electrode alignment. The specially adapted process uses two sacrificial materials, one of which forms a temporary mandrel, and uses a conformal conductive layer to form each control electrode while automatically achieving the required alignment precision.

BRIEF DESCRIPTION OF THE DRAWINGS

FIG. 3 shows a plan view of a high-frequency field-emission microelectronic device made in accordance with the invention.

FIG. 4 shows a plan view of a first alternative layout of a high-frequency field-emission microelectronic device.

FIG. 5 shows a plan view of a second alternative layout of a high-frequency field-emission microelectronic device.

FIGS. *6a* and *6b* together show a flow-chart of a process for fabricating a high-frequency field-emission microelectronic device, performed in accordance with the invention.

FIGS. *7a–7r* together show a series of device sectional elevation views at various stages of the fabrication process illustrated in FIGS. *6a* and *6b*.

DETAILED DESCRIPTION OF THE PREFERRED EMBODIMENTS

The invention may be further understood by considering the following preferred embodiments, which are intended to be exemplary of ways to make and use the invention, including the best mode contemplated by the inventor for carrying out the invention. In this description of the preferred embodiments, references are made to the drawings in which the same reference numbers are used throughout the various figures to designate the same or similar components. It should be noted that the drawings are not drawn to scale. In particular, the vertical scale of cross-section views is exaggerated for clarity, and thicknesses of various elements of the structures are not drawn to a uniform scale.

DEVICE STRUCTURES

Figure 1:
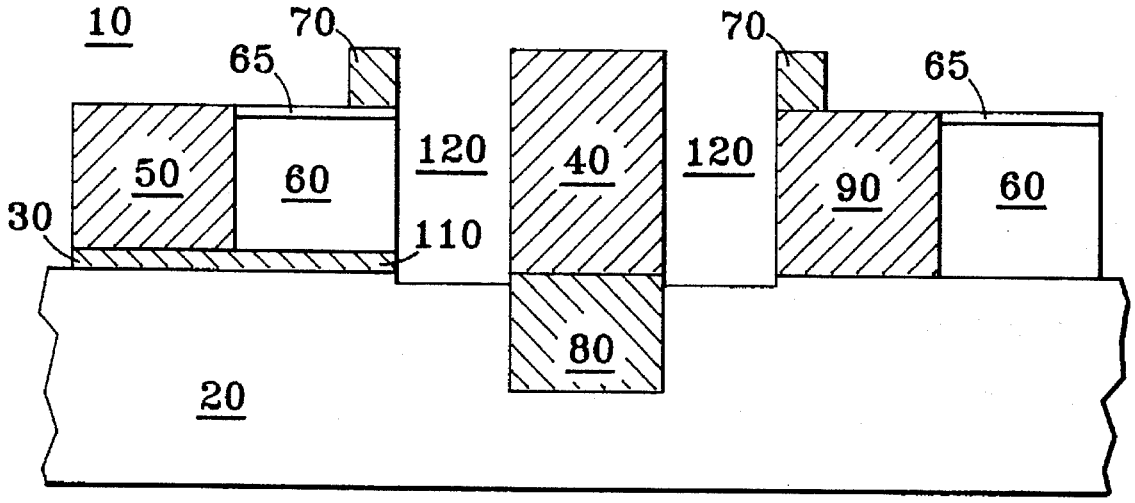
FIG. 1 shows in a first sectional elevation view, a high-frequency field-emission microelectronic device made in accordance with the invention.
Figure 2:
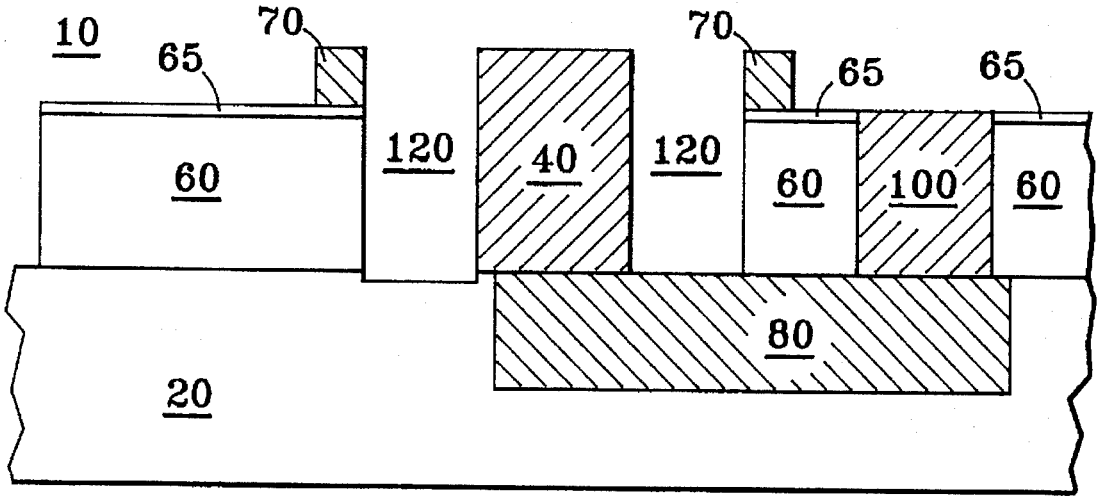
FIG. 2 shows a second sectional elevation view of the device of FIG. 1.

In its simplest form, the high-frequency field-emission device is a triode having a cathode, anode, and control electrode. Of course, a triode device may be operated as a diode if desired. FIG. 1 shows a triode device, generally denoted 10, made in accordance with the invention, in a first sectional elevation view. FIG. 2 shows such a triode device 10, in a second sectional elevation view. FIG. 3 shows a plan view of such a triode device 10. The cross-section of FIG. 2 may be orthogonal to the cross-section of FIG. 1 (as it would be for the device layout shown in the plan view of FIG. 3).

As illustrated in FIGS. 1, 2 and 3, the microelectronic triode device 10 is made on a planar starting substrate 20. It has a planar field-emission cathode 30 that is substantially parallel to substrate 20, emitting electrons toward an anode 40. The length of trajectory traversed by electrons flowing from cathode 30 to anode 40 may be considered as a characteristic dimension of device 10. A contact 50 provides for applying an electrical bias voltage to cathode 30. An insulating layer 60 may provide for electrical isolation of various electrodes and their contacts from each other. Insulating layer 60 may optionally comprise a composite film including a major portion of a primary insulator and a thin etch stop layer 65 of a second material at its top surface, as explained in detail hereinbelow in the description of the preferred fabrication process. Optional etch stop layer 65 is shown in sectional views FIGS. 1 and 2 only. The device has a control electrode 70, lying in a plane spaced from and parallel to cathode 30. The dimensions and alignment of control electrode 70 are selected and controlled, as described further hereinbelow, to minimize inter-electrode capacitances for improved high-frequency performance. A buried anode contact 80, and a conductive contact 100 provide for applying a bias voltage to anode 40. A conductive contact 90 provides for applying an electrical control signal to control electrode 70. Conductive contacts 50, 80, 90, and 100 are spaced apart and may be insulated from each other by intervening portions of insulating material. Cathode 30 has an electron-emitting lateral edge 110, from which anode 40 is spaced apart by a gap 120 of predetermined width. When the device is suitably biased (with anode 40 positive with respect to cathode 30), electrons flow from emitting edge 110 across gap 120 and are collected at anode 40. The dimensions of control electrode 70 as viewed in the sectional elevation views of FIGS. 1 and 2 are controlled to only a small minor fractional part of the width of gap 120 and to only a small minor fractional part of the height of anode 40. When the electrical bias voltages to be applied in practice are high enough to cause field emission from emitting edge 110 of cathode 30, the characteristic length of electron trajectories is about equal to the width of gap 120. In use of the microelectronic triode device 10, the control signal applied to control electrode 70 modulates the current flowing from cathode 30 to anode 40. As is known in the art of field-emission microelectronic devices, the control signal may be made positive with respect to cathode 30, to control emission from the emitting tip of edge 110.

A planar silicon wafer is a suitable starting or base substrate, but the base substrate may be a flat insulator material such as glass, $Al_2O_3$ (especially in the form of sapphire), silicon nitride, etc.. If starting substrate 20 is not an insulator, a film of insulating material such as silicon oxide may be deposited or grown to form an insulating substrate. Alternatively, a conductive substrate may be used as a common anode in some embodiments. If the starting substrate 20 is conductive and in electrical contact with the anode, then at least one insulating film may be used to insulate the cathode and the control electrode from the anode. If the starting substrate 20 is already an insulator, then a separate film of insulating material is not needed to provide an insulating surface. Cathode 30 is a lateral field emission cathode, an ultra-thin metal layer described in more detail below. Anode 40 comprises a layer of conductive material on the top surface of buried anode contact layer 80. Buried anode contact layer 80 makes ohmic electrical contact with anode 40 and is preferably made substantially parallel to substrate 20, with either its upper surface, or its lower surface, or a plane between the two being substantially coplanar with the upper surface of substrate 20. In the preferred embodiments of FIGS. 1 and 2, buried anode contact layer 80 is recessed into insulating substrate 20, and with its top surface placed substantially coplanar with the top surface of substrate 20. In the preferred process (described in detail below) for forming buried anode contact layer 80, a recess is formed in the insulating substrate 20 and the recess is filled with metallization to form buried anode contact 80. Buried anode contact layer 80 may extend under part of anode 40, as shown in FIGS. 1 and 2, or under the entire lower side of anode 40 for some purposes. An insulating layer 60 selectively placed between the plane of buried anode contact layer 80 and the plane of control electrode 70 insulates buried anode contact layer 80 from control electrode 70.

The predetermined gap distance between emitter edge or tip 110 and anode 40 is determined by the width of space 120. The space 120 between cathode 30 and anode 40 and the space above anode 40 can comprise a vacuum or can contain a gas, preferably an inert gas at low pressure. A process for encapsulating space 120 to retain a gas or to achieve and maintain an evacuated condition is described hereinbelow.

Cathode 30 is preferably formed by depositing an ultra-thin film of a conductor with low work function for electron emission, preferably 10–20 nanometers in thickness. Preferred cathode materials are titanium, tungsten, titanium-tungsten alloy, tantalum, molybdenum, or conductive carbon, but many other conductors may be used, such as aluminum, gold, silver, copper, copper-doped aluminum, platinum, palladium, or polycrystalline silicon. For some applications, transparent thin film conductors such as tin oxide or indium tin oxide (ITO) are especially useful. For such applications, the entire device may be made of substantially transparent materials. Such a construction can be employed, for example, in a field-emission display used to augment a visual field viewed through the device, with imagery, graphics, or text superimposed on the field of view.

Anode 40 may be made of any conductive material such as a metal. In applications of the microelectronic device to field-emission displays, anode 40 may be a conductive cathodoluminescent phosphor, or another conductive film coated with a cathodoluminescent phosphor. The height of anode 40 is not critical. The top surface of anode 40 is preferably as high or higher than the plane of emitter 30, but the height of anode 40 above buried anode contact 80 could be zero. Expressed another way, buried anode contact 80 may serve as anode 40, without additional conductive material adding height. Such a structure has extremely small control-electrode-to-anode capacitance.

Insulating layer 60 should have an electric permittivity as low as possible for high frequency performance. The electric permittivity should preferably be less than 12, and even more preferably less than 4. Suitable insulating materials, for example, are aluminum oxide ($Al_2O_3$ ), silicon nitride ($Si_3N_4$), and silicon dioxide ($SiO_2$). FIGS. 1 and 2 show a preferred embodiment in which a single insulating layer 60 serves to support control electrode 70, to insulate it from cathode 30, and to insulate it from buried anode contact 80. For particular purposes, other arrangements (not shown) having two or more such insulating layers may be used, each layer performing one or more of these functions. These separate insulating layers may have different thicknesses or, in some such structures, the thicknesses of various insulating layers may be controlled to be equal. The electric permittivity of each of the various insulating layers should be as described above for insulating layer 60. In the preferred embodiment of FIGS. 1 and 2, emitter 30 and anode contact 80 share a common plane, viz. the bottom surface of emitter 30 and the top surface of anode contact 80 and thus in this sense are substantially coplanar.

In the particular layout shown in FIG. 3, control electrode 70 includes an annular portion, which substantially surrounds a portion of anode 40 in a concentric arrangement. In an overall circuit in which several microelectronic devices are integrated together on a common substrate, such a concentric layout allows some flexibility of design with control-electrode contacts 90 in various positions. In particular these layouts and others allow an advantageous arrangement in which the electron-emitting lateral edge 110 of cathode 30 faces one side of anode 40 and the conductive contact 90 of control electrode 70 is juxtaposed with and spaced apart from another side of anode 40, facing another direction. Such an arrangement facilitates the integration of a number of microelectronic devices in integrated circuits, both by conserving substrate area used and by reducing coupling capacitances between interconnections.

FIGS. 4 and 5 show plan views of alternative layouts of a high-frequency field-emission microelectronic device. In the layout of FIG. 4, the length of control electrode 70 is made short to reduce inter-electrode capacitances further. Such layouts, some with control electrode 70 made even shorter, are preferred for the highest frequency applications. In the layout of FIG. 5, both cathode 30 and an annular portion of control electrode 70 substantially surround a portion of anode 40. A microelectronic device with a substantially concentric layout as in FIG. 5, or any layout having a long active perimeter length, has a relatively high gain and a relatively high cathode current capability. Here, the emitting-edge length is approximately equal to the active perimeter length. In a device having a linear geometry rather than being concentric, the perimeter length would be measured perpendicularly to the plane of FIG. 1. Other advantages of such layouts as FIG. 5 include ease of integration of many devices on a substrate. Another advantage is improved signal strength in ultra high frequency device applications such as signal generators, amplifiers, and transmitters and/or receivers for electromagnetic radiation.

An important feature of the microelectronic field emission device 10 is shown clearly in FIGS. 1, 2, 3, 4 and 5: viz. that the gap 120 between anode 40 and both cathode 30 and control electrode 70 may be made to have one or more common edges with cathode 30 (at its emitting lateral edge 110) and with control electrode 70, so that the latter elements are automatically aligned by the formation of space 120. This is commonly termed a self-aligned structure. Thus, especially when device 10 is fabricated by the preferred fabrication method described below, alignment of control electrode 70 both with respect to anode 40 and with respect to emitting lateral edge 110 of cathode 30 may be controlled very precisely. The preferred fabrication method described below also controls the width of gap 120 very precisely in comparison with fabrication methods that depend on lithographic tolerances to define the spacing between emitter and anode.

To consider a typical but not limiting example, the various elements may have the following dimensions: Emitter 30 may be made about 10 nanometers thick. Control electrode 70 may be made about 30 nanometers high (measured perpendicularly to substrate 20) and about 20 nanometers wide (measured parallel to substrate 20). Both the emitting edge 110 of emitter 30 and the corresponding side of control electrode 70 may be spaced about 200 nanometers from anode 40. That is, gap 120 may be 200 nanometers wide. Anode 40 may be about 100 nanometers high, measured from substrate 20 or buried anode contact 80. Insulating layer 60 may have a thickness of about 50 nanometers and an electric permittivity of about 3.9. Given these typical dimensions and permittivity, the emitter-to-control-electrode capacitance amounts to only about $14\times10^{-18}$ farads per micrometer of emitter edge, plus a small capacitance due to the fringing field. With the same assumptions, the anode -to-control-electrode capacitance is only about $26\times10^{-19}$ farads per micrometer of control electrode length, plus a small capacitance due to the fringing field. These appear to be the lowest inter-electrode capacitances achieved in field-emission microelectronic devices to date.

FABRICATION PROCESS

Figure 6A:
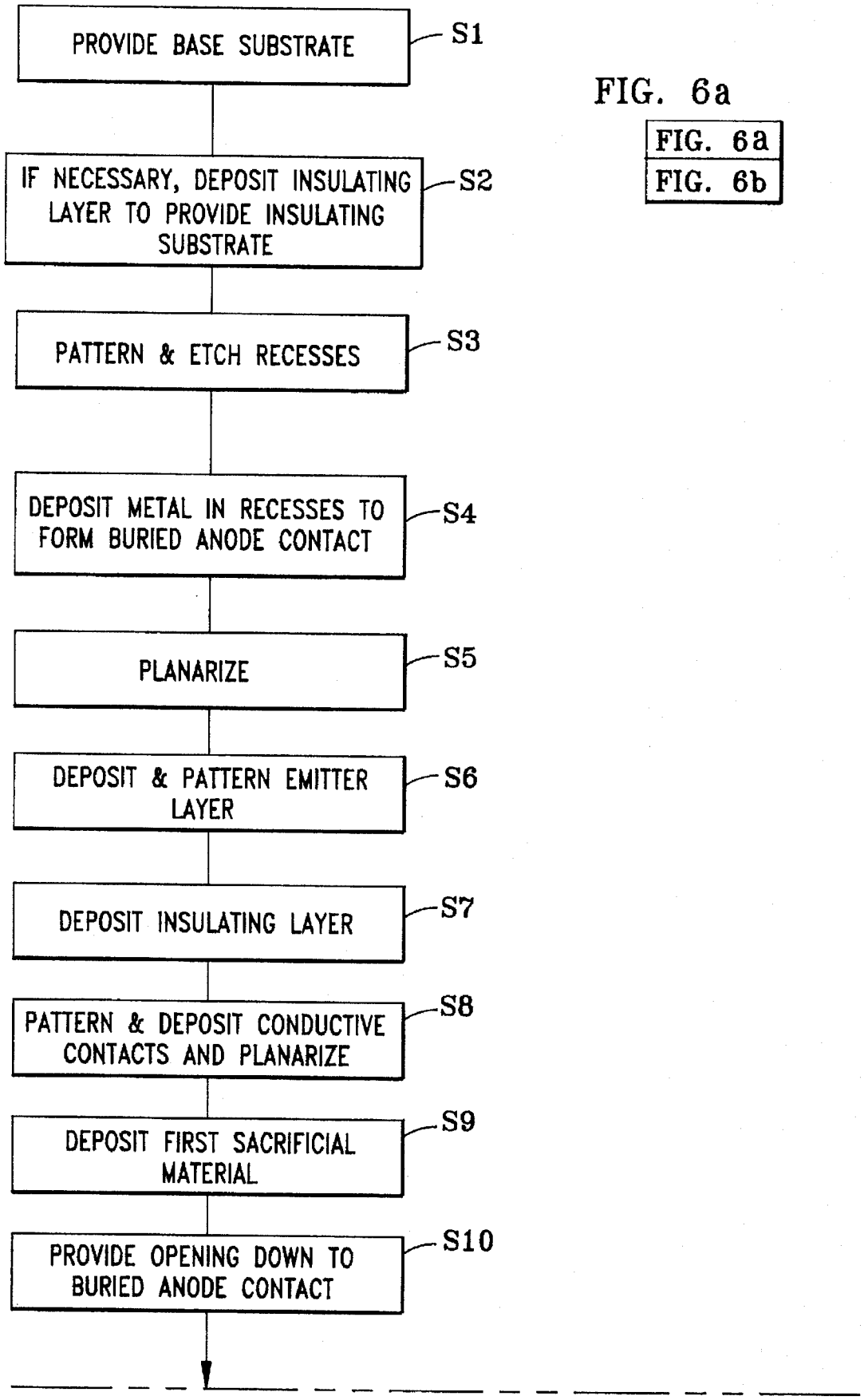
Figure 6B:
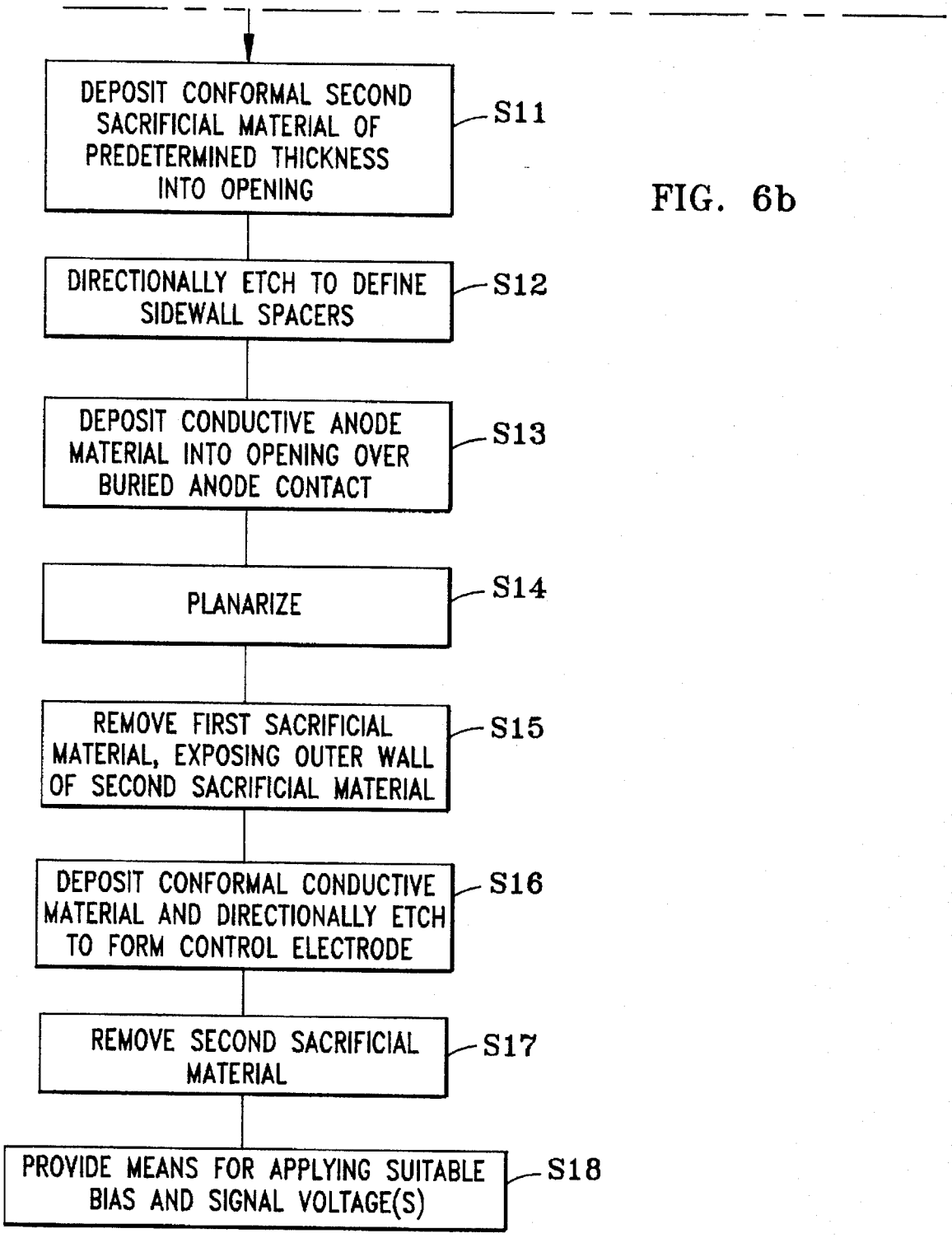
Figure 7A:
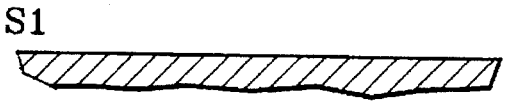
Figure 7B:
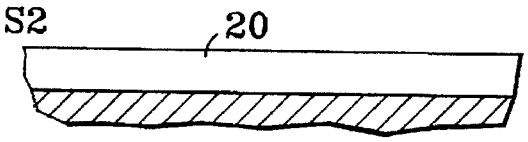
Figure 7C:
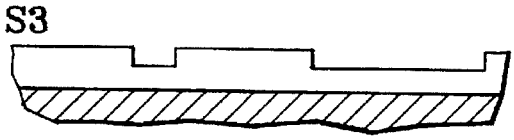
Figure 7D:
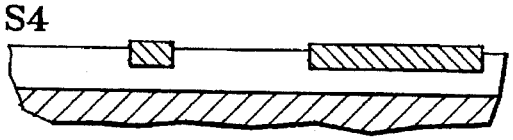
Figure 7E:
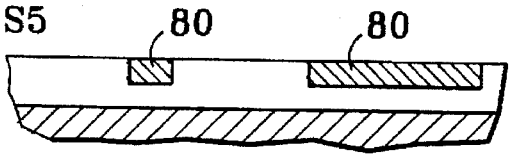
Figure 7F:
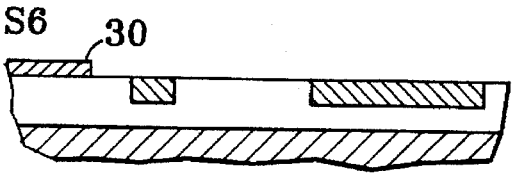
Figure 7G:
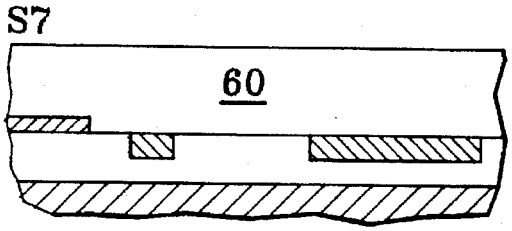
Figure 7H:
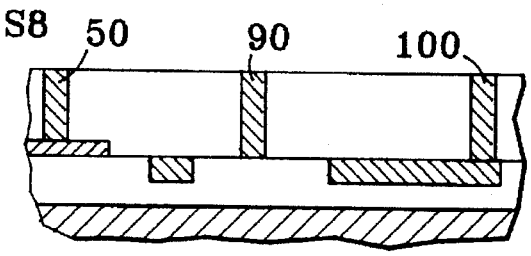
Figure 7I:
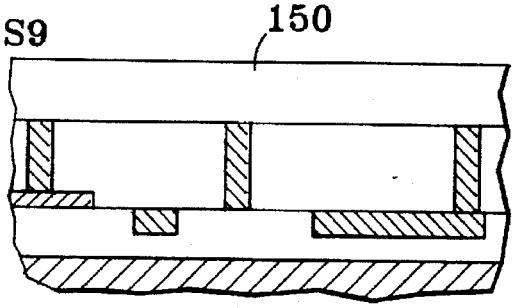
Figure 7J:
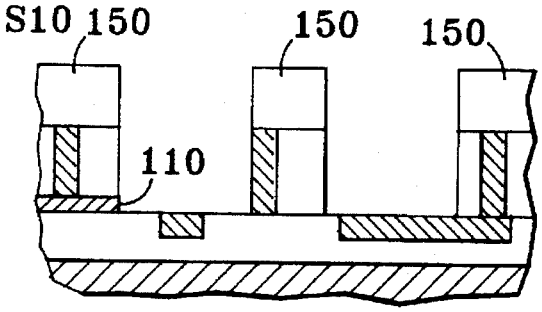
Figure 7K:
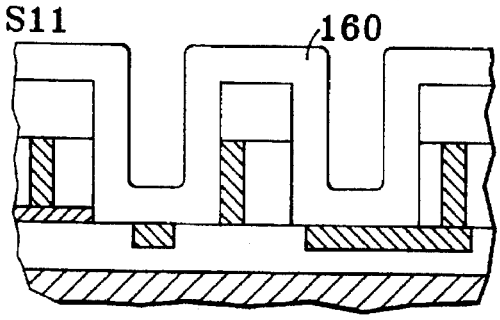
Figure 7L:
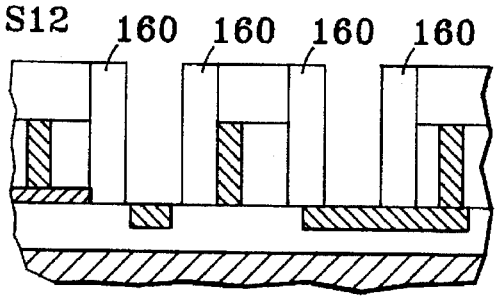
Figure 7M:
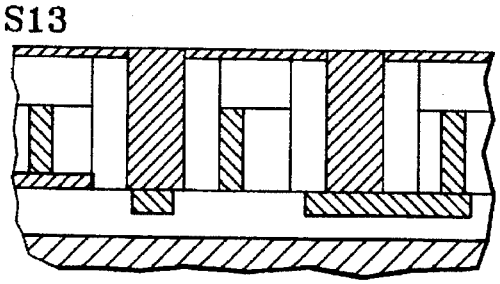
Figure 7N:
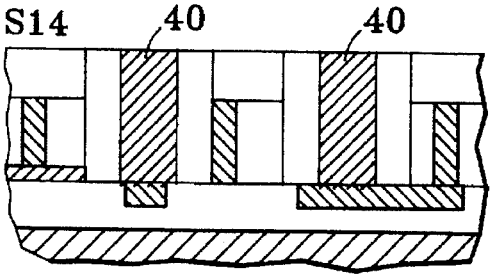
Figure 7O:
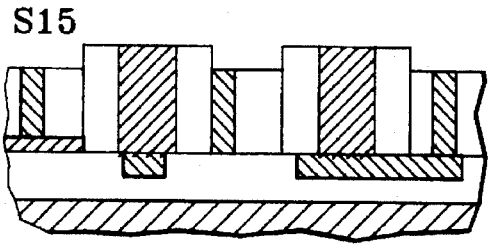
Figure 7P:
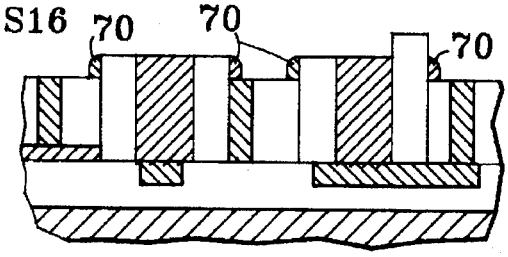
Figure 7Q:
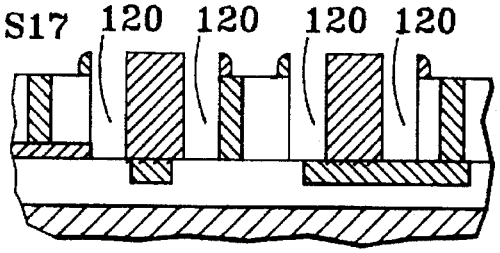
Figure 7R:
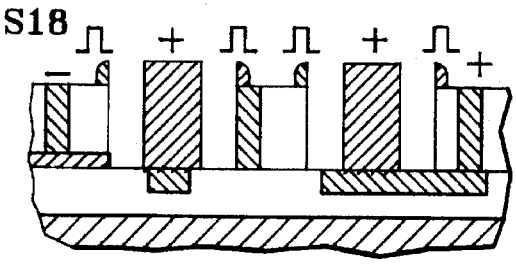

FIGS. 6*a* and 6*b* together show schematically a flow diagram illustrating a preferred embodiment of a fabrication process performed in accordance with the invention, with step numbers indicated by references S1, etc.. FIGS. 7*a*–7*r* together show a sequence of sectional views of a display cell at various stages of the fabrication process depicted in FIGS. 6*a* and 6*b*. Each sectional view of FIGS. 7*a*–7*r* shows the result of the process step indicated next to the sectional view.

The identities and functions of individual elements in the sectional views of FIGS. *7a–7r* will be apparent by comparison with FIGS. 1 and 2. In particular, the left side of each sectional view of FIGS. *7a–7r* corresponds to FIG. 1 and the right side of each cross-section in FIGS. *7a–7r* corresponds to FIG. 2. The detailed process illustrated is a process for a triode device with one control electrode. It will be apparent to those skilled in this art that analogous processes may be practiced to fabricate devices, such as tetrodes, with more than one control electrode, or diodes with no control electrode, by repeating or omitting appropriate steps of the process illustrated in the drawing and described herein. An overall outline of a fabrication process for a simple triode device structure is described first, referring to corresponding process steps (indicated by reference numbers S1, etc.) of the more detailed process, followed by a detailed description of the process. Reference numerals of structural elements refer to the corresponding elements in FIGS. 1–5, except where such reference numerals occur only in FIGS. *7a–7r*.

An overall method of fabricating the field-emission device generally comprises the following steps: providing an insulating substrate (step S1 and if necessary step S2); patterning and depositing a conductive layer (steps S3 and S4) in or on the upper surface of the insulating substrate to form an anode contact layer; depositing and patterning a conductive layer (step S6) having a thickness of only several tens of nanometers extending parallel to the upper surface of the substrate to form an emitter layer; depositing or growing an insulating layer (step S7); patterning and depositing conductive contacts or studs where needed (step S8); depositing a first sacrificial material (step S9); providing an opening (step S10) down to the anode contact layer and through the various other layers above it, including the emitter layer, thus forming an emitting edge of the emitter layer; placing a conformal layer of a second sacrificial material only on the walls of the opening provided in step S10 to a predetermined thickness to make a spacer (steps S11 and S12); filling the opening at least partially with a conductive anode material (step S13) such that the conformal layer spaces the anode material from the emitting edge of the emitter layer, where the predetermined conformal layer thickness equals a desired spatial distance between the emitter edge of the emitter layer and the anode; planarizing (step S14); removing the first sacrificial material (step S15), thus exposing the outer walls of the second sacrificial material to form a temporary mandrel; depositing a conformal conductive material (step S16) in contact with those outer walls and directionally etching it to form a control electrode; removing the second sacrificial material (step S17), thus opening the emitter-to-anode gap; and (by way of preparation in steps S4, S8, S13 and finally in step S18) providing means for applying an electrical bias voltage to the emitter layer and to the anode layer, sufficient to cause cold cathode emission current of electrons from the emitter edge to the anode, and a signal voltage(s) to the control electrode(s) to modulate the current.

To fabricate the high-frequency triode field-emission device 10 with one control electrode 70, the full process illustrated in FIGS. *6a, 6b, 7a–7r* is preferably performed. A base substrate is provided (step S1), which may be a silicon wafer. In general, the base substrate may be a conductive material, a semiconductive material, an insulating material, or a semi-insulating material. An insulating layer is deposited (step S2) if necessary to make an insulating substrate 20. This may be done, for example, by growing a film of silicon oxide approximately one micrometer thick on a silicon substrate. If the base substrate is already an insulator, step S2 may be omitted. Whether substrate 20 is a monolithic insulator or a base substrate covered with an insulating film, it may be made entirely of transparent materials if desired, for use in some display applications.

A pattern is defined on the insulator surface for depositing a conductive material. In the preferred process, a pattern of recesses is defined and etched (step S3) into the surface of the insulating substrate 20. In step S4, conductive material is deposited in the recesses to form a buried anode contact 80, which is then planarized (step S5). The conductive material deposited in step S4 may be a metal such as aluminum, tungsten, titanium, etc., as shown in FIG. *6a*, or may be a transparent conductor such as tin oxide, indium tin oxide etc. For applications using a common anode for all devices made on a substrate, the substrate may be conductive and perform the function of a buried anode contact. For such applications, additional steps are required, using conventional methods to provide an insulator which insulates the emitter from the substrate and control electrode contact. An ultra-thin layer of conductive material of suitably low work function is deposited (step S6) to form an emitter layer 30, and patterned. Preferred emitter materials are titanium, tungsten, titanium-tungsten alloy, tantalum, or molybdenum, but many other conductors may be used, such as aluminum, gold, silver, copper, copper-doped aluminum, platinum, palladium, polycrystalline silicon, conductive carbon, etc. or transparent thin film conductors such as tin oxide or indium tin oxide (ITO). The deposition of emitter layer 30 in step S6 is controlled to form a film preferably of about 10–20 nanometers thickness in order to have an emitter edge or tip in the final structure that has a radius of curvature preferably less than 5 nanometers and more preferably less than 10 nanometers. The emitter layer 30 may be deposited in a recess pattern and planarized, as in the case of the buried anode contact layer 80. An insulator 60 is deposited (step S7) over the emitter layer. This may be a chemical vapor deposition of silicon oxide to a thickness of about 50 to 2,000 nanometers, for example, or more preferably to a thickness of about 50 to 200 nanometers. Alternatively, insulator layer 60 may be another insulator material such as aluminum oxide or silicon nitride. Silicon oxide is preferred for its relatively low permittivity. Preferably insulator layer 60 also includes a thin layer 65 of another material deposited on its top surface as part of step S7 to provide an etch stop later in the process. For example, a very thin etch stop layer 65 of silicon nitride may be deposited at the top surface of a layer of silicon oxide to complete insulator layer 60 in this preferred process.

Where conductive contacts 50, 90 and/or 100 are needed, contact holes and conductive material are patterned and deposited (step S8) to form them. In this patterning, each conductive contact is aligned with respect to its corresponding electrode. In the case of conductive contact 90 for control electrode 70, this alignment is to the anticipated location of the control electrode, and the precise alignment occurs automatically later in the process, as it is a self-aligning process. A first sacrificial material 150 is deposited and, if necessary, planarized (step S9) to a predetermined thickness. The first sacrificial material 150 may, for example, be silicon oxide, deposited by chemical vapor deposition (CVD) to a thickness of 20 to 50 nanometers, for example. An important characteristic used in selecting this first sacrificial material 150 is that it be relatively resistant to a procedure used later in step S12 to directionally etch a second sacrificial material. Examples of suitable materials are silicon oxide, silicon nitride, aluminum oxide, and any one of a number of organic polymers. A particular choice of sacrificial material may require provision of optional thin etch stop layer 65, to prevent etching of insulator layer 60 in step S15. The preferred material for the first sacrificial material 150 is silicon oxide, used in conjunction with an etch-stop layer 65 of silicon nitride.

In step S10, an opening is provided to the buried anode contact layer 80. This opening is patterned to provide space for anode 40 and space 120, and the pattern is made to intersect at least some portions of emitter layer 30, to define emitting edge 110 of emitter layer 30. This step may be performed by using conventional directional etching processes such as ion milling, reactive ion etching (sometimes called "trench etching" in the semiconductor fabrication literature), or reverse sputtering. Ion milling is the preferred method. In a preferred mode of the process illustrated in the drawings, the etching in step S10 extends a short distance into the insulating substrate, thus relieving the emitting edge 110 of emitter layer 30. The opening may then also extend slightly into insulating substrate 20, beyond an edge of buried anode contact layer 80 as well. Advantages of this preferred mode include reduction of secondary emission and reduction of charge trapping at the insulator surface. This slight etching into the surface of insulator 20, the depth of which may be only a few tens of nanometers or less, is shown in FIGS. 1 and 2, but not shown in FIGS. 6*a*, 6*b*, 7*a*–7*r*.

This description of a preferred fabrication process continues from this point with reference to FIG. 6*b* and FIGS. 7*k*–7*r*, respectively showing the remaining fabrication steps and the corresponding sectional views of the device. A conformal second sacrificial material 160 is deposited in step S11, and directionally etched in step S12, to remove the conformal layer 160 everywhere except on the sidewalls of the opening provided in step S10. This provides a spacer of precise predetermined thickness on the sidewalls of that opening. Preferred spacer thickness is in the range of about 100 to 400 nanometers. The best spacer dimension depends on a number of variables, such as the emitter work function, the emitter edge radius of curvature, and the operating bias voltage range desired. That spacer will define the predetermined width of gap 120 separating the field emitter edge 110 from anode 40 in the completed field emission device structure. The conformal second sacrificial material layer 160 could be any of several conformal materials such as parylene. Some important characteristics used in selecting this second sacrificial material 160 are that it be conformal, and that it be directionally etchable by a process to which the first sacrificial material 150 is relatively resistant. This method of defining the width of gap 120 allows much more precise and reproducible control of the gap width than methods that depend on lithographic tolerances.

In step S13, a conductive material is deposited into the opening onto buried anode contact layer 80 to form anode 40, and any excess conductive material not in the opening is removed in planarization step S14 (by polishing, for example). Chemical-mechanical polishing is a preferred mode for planarization. In step S15, the first sacrificial material 150 is removed, thus exposing outer walls of second sacrificial material 160. If the first sacrificial material 150 is silicon oxide, it may be removed by etching with hydrofluoric acid (I–F) or buffered HF, for example, without appreciably affecting sidewalls of the second sacrificial material 160, such as parylene. Step S15 forms a temporary mandrel used in step S16 to form control electrode 70.

In step S16, a conformal conductive material is deposited and directionally etched to form control electrode 70. The conformal conductive material is deposited onto at least the sidewalls of second sacrificial material 160 that were exposed in step S15 (the aforementioned mandrel), onto adjacent portions of the top surface of insulating layer 60, and onto at least a portion of conductive contact 90. The deposition is controlled to deposit a thickness of conformal conductive material suitable to form the desired width of control electrode 70 (measured parallel to substrate 20). Formation of control electrode 70 with the desired final dimensions is completed in step S16 by directionally etching with a reactive ion etch, ion milling, or reverse sputtering, for example. To minimize interelectrode capacitances, the desired width is controlled to be only a small minor fractional part of the width of gap 120. If anode 40 has a height above its buried anode contact 80, then the height of control electrode 70 is controlled to be only a small minor fractional part of that height of anode 40. This part of the process also ensures the precise alignment of control electrode 70, both with respect to the emitting edge 110 of emitter 30 and with respect to anode 40. The conformal conductive material deposited in step S6 may be any conductor. For example, it may be any conductive form of aluminum, carbon, copper, doped diamond, indium, indium oxide, indium-tin oxide, iron, gold, molybdenum, rhodium, silver, tungsten, tantalum, tin, tin oxide, titanium, titanium silicide, tungsten, palladium, platinum, polysilicon, zinc, or mixtures, solid solutions, or alloys of these materials. The deposition of step S6 may be done by any method known in the art for conformal depositions, specifically including evaporation, sputtering, or electroless plating, for example.

In step S17, the conformal layer of second sacrificial material 160 is removed, by a conventional plasma etch step for example, leaving the previously mentioned predetermined gap in space 120 between emitter edge 110 and anode 40. In step S18, means are provided for applying suitable electrical bias voltages to anode and cathode, and for applying suitable signal voltages to the control electrode. Such means may include, for example, contact pads selectively provided at the device top surface to make electrical contact with contacts 50, 90, and 100, and optionally may include wire bonds, means for tape automated bonding, flip-chip or C4 bonding, etc. In use of the device, of course, conventional power supplies and signal sources must be provided to supply the appropriate bias voltages and control signals. These will include providing sufficient voltage amplitude of the correct polarity (an, ode positive) to cause cold-cathode field emission of electron current from emitter edge 110 to anode 40 and anode buried contact 80. If desired, a passivation layer (not shown) may be applied to the device top surface, except where there are conductive contact studs and/or contact pads needed to make electrical contacts.

It will be appreciated by those skilled in the art that integrated circuits or arrays of high-frequency field-emission devices may be made by simultaneously performing each step of the fabrication process described herein at a multiplicity of device sites on the same substrate, while providing interconnections. An integrated circuit or array of field-emission devices made in accordance with the present invention has each device made as described herein, and the devices are arranged as cells containing at least one emitter and at least one anode per cell. The cells are arranged along rows and columns, with the anodes interconnected along the columns and with the emitters interconnected along the rows, for example. The control electrodes may have interconnections along either rows or columns, between other interconnections. Such integrated circuits may be interconnected to perform logic or memory functions, or to make UHF oscillators, amplifiers, transmitters, and receivers, for example.

If it is desired to have the high-frequency field-emission device operating with a vacuum or a low pressure inert gas in gap 120, it is necessary to enclose a space or cavity including gap 120. This can be done by a process similar to that described in the anonymous publication "Ionizable Gas Device Compatible with Integrated Circuit Device Size and Processing," publication 30510 in Research Disclosure, no. 305, (England, Kenneth Mason Publications, September 1989). Such a process can be begun by etching a small auxiliary opening, connected to the opening provided in step S10. This auxiliary opening need not necessarily extend as deeply as the level of buried anode contact layer 80. This auxiliary opening may be made at a portion of the cavity spaced away from the emitter edge area. The opening for the main cavity and the connected auxiliary opening are both filled temporarily with a sacrificial organic material, such as parylene, and then planarized. An inorganic insulator is deposited, extending over the entire device surface including over the sacrificial material, to enclose the cavity. A hole is made in the inorganic insulator (by reactive ion etching or wet etching, for example) only over the auxiliary opening. The sacrificial organic material is removed from within the cavity by a plasma etch, such as an oxygen plasma etch, which operates through the hole. The atmosphere around the device is then removed to evacuate the cavity. If an inert gas filler is desired, then that gas is introduced at the desired pressure. Then the hole and auxiliary opening are immediately filled by sputter-depositing an inorganic insulator to plug the hole. The plug of inorganic insulator seals the cavity and retains either the vacuum or any inert gas introduced. This process for vacuum or gas atmospheres is not illustrated in FIGS. *6a, 6b, 7a–7r.*

INDUSTRIAL APPLICABILITY

There are many diverse uses for the high-frequency field-emission microelectronic device structure and fabrication process of this invention, especially in high-speed computer logic and memory circuits, but also in high-speed flat panel displays for displaying images and for displaying character or graphic information. It is expected that the type of high-frequency field-emission microelectronic device made with this invention can replace many existing semiconductor devices, because of their lower manufacturing complexity and cost, lower power consumption, and improved high frequency performance. In embodiments using substantially transparent substrates and films, displays incorporating the devices of the present invention are expected to be used in new kinds of applications, such as virtual reality systems and especially augmented-reality systems.

From the foregoing description, one skilled in the art can easily ascertain the essential characteristics of this invention, and without departing from the spirit and scope thereof, can make various changes and modifications of the invention to adapt it to various usages and conditions. Other embodiments of the invention will be apparent to those skilled in the art from a consideration of this specification or from practice of the invention disclosed herein. For example, the order of process steps may be varied and materials with equivalent characteristics may be substituted for the specific materials described in the examples. It is intended that the specification and examples be considered as exemplary only, with the true scope and spirit of the invention being defined by the following claims.

Having described my invention, I claim:

1. A method of fabricating a high frequency field emission device, comprising the steps of:

(a) providing an insulating substrate;

(b) disposing and patterning a conductive anode contact on said substrate;

(c) disposing and patterning a thin conductive emitter film on said substrate, said emitter film being spaced apart from said anode contact;

(d) disposing an insulating film over said anode contact and said emitter film;

(e) patterning and etching said insulating film to provide openings at least partially aligned to said anode contact and to said emitter film, filling said openings with a conductive material to form contacts, and planarizing the resulting surface to form a planarized surface;

(f) depositing a first sacrificial material, covering said planarized surface;

(g) providing an opening through at least said first sacrificial material, said insulating film, and said emitter film, thereby forming an edge on at least said emitter film, said opening having side walls;

(h) disposing a second sacrificial material to a first predetermined thickness only on said side walls of said opening;

(i) filling said opening at least partially with conductive material to form an anode and planarizing the resulting surface;

(j) removing said first sacrificial material, thereby exposing an outer wall surface of said second sacrificial material;

(k) disposing a conformal conductive material to a second predetermined thickness over said anode, said contacts, and said insulating film, while controlling said second predetermined thickness to be a minor fractional part of said first predetermined thickness;

(l) directionally etching said conformal conductive material while leaving conformal conductive material in contact with said outer wall surface of said second sacrificial material to form a control electrode;

(m) removing said second sacrificial material;

(n) providing means for applying an electrical bias voltage to said emitter layer and to said anode contact layer, said bias voltage to be applied being sufficient to cause cold cathode emission current of electrons from said edge of said emitter layer to said anode; and (o) providing means for applying an electrical control signal to said control electrode sufficient to control said current of electrons.

2. A method of fabricating a high frequency field emission device as recited in claim 1, wherein said insulating-substrate-providing step (a) further comprises providing a substantially transparent substrate.

3. A method of fabricating a high frequency field emission device as recited in claim 1, wherein said insulating-substrate-providing step (a) further comprises the steps of:

(i) providing a base substrate selected from the list consisting of a conductive material, a semiconductive material, an insulating material, and a semi-insulating material; and (ii) disposing an insulating film on said base substrate.

4. A method of fabricating a high frequency field emission device as recited in claim 3, wherein said base-substrate-providing step (i) comprises providing a substantially transparent base substrate, and said insulating-film-disposing step (ii) comprises disposing a substantially transparent film.

5. A method of fabricating a high frequency field emission device as recited in claim 1, wherein said insulator-disposing step (d) comprises disposing a first sublayer of silicon oxide, and disposing a second sublayer of silicon nitride to provide an etch stop.

6. A method of fabricating a high frequency field emission device as recited in claim 1, wherein said opening-providing step (g) includes providing said opening to at least the bottom surface of said emitter film, thereby exposing the entirety of said edge of said emitter film.

7. A method of fabricating a high frequency field emission device as recited in claim 1, wherein said opening-providing step (g) includes providing said opening beyond the bottom surface of said emitter film, thereby exposing a portion of said insulating substrate below said emitter film.

8. A method of fabricating a high frequency field emission device, comprising the steps of:

(a) providing an insulating substrate;

(b) disposing and patterning a first conductive layer upon said substrate to form an anode contact layer;

(c) disposing and patterning a second conductive layer having a thickness of only several tens of nanometers relative to the upper surface of said substrate to form an emitter layer, said second conductive layer being disposed so as to extend parallel to the upper surface of said substrate;

(d) disposing an insulating film over said anode contact layer and said emitter layer, including disposing a first sublayer of silicon oxide and disposing a second sublayer of silicon nitride to provide an etch stop;

(e) disposing and patterning a third conductive layer in at least partial alignment with said anode contact layer and with said emitter layer;

(f) disposing a first sacrificial material coveting said third conductive layer, said insulating film, said anode contact layer, and said emitter layer;

(g) providing an opening extending at least through said first sacrificial material, said insulating film, said emitter layer, and a portion of said insulating substrate, thereby forming an edge of at least said emitter layer;

(h) disposing a conformal layer of a second sacrificial material only on the walls of said opening provided in step (g), said conformal layer of a second sacrificial material being of a first predetermined thickness;

(i) filling said opening at least partially with a fourth conductive layer to form an anode, such that said conformal layer spaces said anode from said edge of said emitter layer formed in step (g), said first predetermined thickness of said conformal layer equaling a desired spatial distance between said edge of said emitter layer and said anode, and planarizing the resulting surface;

(j) removing said first sacrificial material, thereby exposing outer walls of said second sacrificial material;

(k) disposing a conformal conductive layer only on said exposed outer walls of said second sacrificial material;

(l) removing said second sacrificial material;

(m) providing means for applying an electrical bias voltage to said emitter layer and to said anode, said bias voltage to be applied being sufficient to cause cold cathode emission current of electrons from said edge of said emitter layer to said anode; and (n) providing means for applying an electrical control signal to said conformal conductive layer sufficient to control said current of electrons.

9. A method of fabricating a high frequency field emission device as recited in claim 8, wherein said substrate providing step (a) further comprises providing a base substrate of a material selected from a list consisting of a conductive material, a semiconductive material, an insulating material, and a semi-insulating material; and disposing an insulating film on said base substrate to form an insulating substrate.

10. A method of fabricating a high frequency field emission device as recited in claim 9, wherein said base-substrate-providing step comprises providing a transparent substrate, and said insulating-film-disposing step comprises disposing a transparent insulating film.

11. A method of fabricating a high frequency field emission device, comprising the steps of:

(a) providing a planar silicon base substrate;

(b) oxidizing said silicon base substrate to form a layer of silicon oxide of about one micrometer or greater thickness to form an insulating substrate having an upper surface;

(c) patterning and etching said insulating substrate to form a first opening for conductive material, and disposing said conductive material in said first opening to form a buried anode contact layer;

(d) disposing and patterning a conductive layer having a thickness of only several tens of nanometers relative to said upper surface of said insulating substrate and extending parallel to said upper surface to form an emitter layer;

(e) disposing about 50 nanometers thickness of a first insulating film over at least said buried anode contact layer and said emitter layer, (f) patterning and etching said first insulating film to form second openings for conductive material, and disposing said conductive material in said second openings to form contact studs making ohmic contact with at least said buried anode contact layer and said emitter layer;

(g) disposing a layer to about 20 to 50 nanometers thickness of a first sacrificial material characterized by being etchable by an etchant to which said first insulating film is resistant, (h) providing an opening through at least said first sacrificial material, said first insulating film, and said emitter layer, thereby forming an edge of at least said emitter layer, said opening having side walls and being at least partially aligned with said buried anode contact layer;

(i) disposing a conformal layer of a second sacrificial material only on said side walls of said opening provided in step (h), said second sacrificial material being of a first predetermined thickness;

(j) filling said opening at least partially with a conductive material to form an anode and planarizing the resultant surface;

(k) removing said first sacrificial material to expose an outer wall of said second sacrificial material and the top surface of said first insulating film;

(l) disposing a conformal conductive material to a second predetermined thickness over at least said outer wall of said second sacrificial material and said top surface of said first insulating film, while controlling said second predetermined thickness to be a minor fractional part of said first predetermined thickness;

(m) directionally etching said conformal conductive material to form a control electrode on said outer wall of said second sacrificial material and on said top surface of said first insulating film;

(n) removing said second sacrificial material to produce a gap between said anode and said edge of said emitter layer;

(o) providing means for applying an electrical bias voltage to said emitter layer and to said buried anode contact layer, said bias voltage to be applied being sufficient to cause cold cathode emission current of electrons from said edge of said emitter layer to said anode; and (p) providing means for applying an electrical control signal to said control electrode sufficient to control said current of electrons.

12. A method as recited in claim 11, wherein said first insulating-film-disposing step (e) is performed by disposing a layer comprising silicon oxide.

13. A method as recited in claim 11, wherein said first insulating-film-disposing step (e) is performed by disposing a first sub-layer comprising silicon oxide, and a second sublayer comprising silicon nitride to provide an etch stop.

14. A method of fabricating a high frequency field emission device as recited in claim 11, wherein said opening-providing step (h) includes providing said opening to at least the bottom surface of said emitter layer, thereby exposing the entirety of said edge of said emitter layer.

15. A method of fabricating a high frequency field emission device as recited in claim 11, wherein said opening-providing step (h) includes providing said opening beyond the bottom surface of said emitter layer, thereby exposing a portion of said insulating substrate below said emitter layer.

16. A method as recited in claim 11, wherein said first sacrificial material layer disposing step (g) is performed by chemical vapor depositing of silicon oxide.

17. A method as recited in claim 11, wherein said second sacrificial material conformal layer disposing step (i) is performed by depositing parylene.

18. A method as recited in claim 11, wherein said conformal conductive material disposing step (I) is performed by depositing a conductive material selected from the list consisting of aluminum, carbon, copper, doped diamond, indium, indium oxide, indium-tin oxide, iron, gold, molybdenum, rhodium, silver, tungsten, tantalum, tin, tin oxide, titanium, titanium silicide, tungsten, palladium, platinum, polysilicon, zinc, mixtures thereof, solid solutions thereof, and alloys thereof.

19. A method of fabricating a high frequency field emission device, comprising the steps of:

(a) providing a planar silicon base substrate;

(b) oxidizing said silicon base substrate to form a layer of silicon oxide of about one micrometer or greater thickness to form an insulating substrate having an upper surface;

(c) patterning and etching said insulating substrate to form a first opening for conductive material, and disposing said conductive material in said first opening to form a buried anode contact layer;

(d) disposing and patterning a conductive layer having a thickness of only several tens of nanometers relative to said upper surface of said insulating substrate and extending parallel to said upper surface to form an emitter layer;

(e) disposing about 50 nanometers thickness of a first insulating film over at least said buried anode contact layer and said emitter layer, including disposing a first sublayer of silicon oxide and a second sublayer of silicon nitride to provide an etch stop;

(f) patterning and etching said first insulating film of silicon oxide to form second openings for conductive material, and disposing said conductive material in said second openings to form contact studs making ohmic contact with at least one of said buried anode contact layer and said emitter layer;

(g) disposing a layer to about 20 to 50 nanometers thickness of a first sacrificial material characterized by being etchable by an etchant to which said first insulating film is resistant, (h) providing an opening through at least said first sacrificial material, said first insulating film, and said emitter layer, and extending into said upper surface of said insulating substrate, thereby forming an edge of at least said emitter layer, said opening having side walls and being at least partially aligned with said buried anode contact layer;

(i) disposing a conformal layer of a parylene second sacrificial material only on said side walls of said opening provided in step (h), said second sacrificial material being of a first predetermined thickness;

(j) filling said opening at least partially with a conductive material to form an anode and planarizing the resultant surface;

(k) removing said first sacrificial material to said etch stop, thereby exposing an outer wall of said second sacrificial material and the top surface of said first insulating film;

(l) disposing a conformal conductive material to a second predetermined thickness over at least said outer wall of said second sacrificial material and said top surface of said first insulating film, while controlling said second predetermined thickness to be a minor fractional part of said first predetermined thickness;

(m) directionally etching said conformal conductive material to form a control electrode on said outer wall of said second sacrificial material and on said top surface of said first insulating film;

(n) removing said second sacrificial material to produce a gap between said anode and said edge of said emitter layer;

(o) providing means for applying an electrical bias voltage to said emitter layer and to said buried anode contact layer, said bias voltage to be applied being sufficient to cause cold cathode emission current of electrons from said edge of said emitter layer to said anode; and (p) providing means for applying an electrical control signal to said control electrode sufficient to control said current of electrons.

* * * * *